US007562795B2

(12) United States Patent
Whitney

(10) Patent No.: US 7,562,795 B2
(45) **Date of Patent: *Jul. 21, 2009**

(54) VISCOUS POLYORGANOSILOXANE FLUID DISPENSER

(75) Inventor: Peter M. Whitney, Clifton Park, NY (US)

(73) Assignee: Momentive Performance Materials, Albany, NY (US)

( * ) Notice: Subject to any disclaimer, the term of this patent is extended or adjusted under 35 U.S.C. 154(b) by 225 days.

This patent is subject to a terminal disclaimer.

(21) Appl. No.: 11/765,090

(22) Filed: Jun. 19, 2007

(65) Prior Publication Data

US 2009/0101668 A1 Apr. 23, 2009

Related U.S. Application Data

(62) Division of application No. 11/465,823, filed on Aug. 21, 2006, now Pat. No. 7,255,249, which is a division of application No. 11/042,105, filed on Jan. 26, 2005, now Pat. No. 7,156,268, which is a division of application No. 10/207,786, filed on Jul. 31, 2002, now Pat. No. 6,880,735.

(51) Int. Cl.
*B67D 3/00* (2006.01)

(52) U.S. Cl. ..... 222/539; 222/93; 222/181.2; 222/568; 401/266

(58) Field of Classification Search ..... 222/92–93, 222/105–107, 566–568, 181.2, 530, 181.3, 222/575, 325–327, 538–539; 401/265–266
See application file for complete search history.

(56) References Cited

U.S. PATENT DOCUMENTS

| | | | | |
|---|---|---|---|---|
| 2,413,438 A | | 12/1946 | Doose | |
| 2,478,078 A | | 8/1949 | Batterfield | |
| 2,888,695 A | | 6/1959 | Anderson et al. | |
| 3,078,017 A | | 2/1963 | Waskonig et al. | |
| 3,477,973 A | * | 11/1969 | Lengnick et al. | 528/18 |
| 3,586,213 A | | 6/1971 | Gill | |
| 3,656,660 A | | 4/1972 | Mueller | |
| 3,963,357 A | | 6/1976 | Crisp | |
| 4,211,247 A | | 7/1980 | Morganroth | |
| 4,232,721 A | | 11/1980 | Martin | |
| 4,857,582 A | * | 8/1989 | Wolfgruber et al. | 524/730 |
| 5,048,677 A | * | 9/1991 | Pedracine | 206/573 |
| 5,199,611 A | | 4/1993 | Santefort et al. | |
| 5,217,144 A | | 6/1993 | Santefort et al. | |
| 5,263,610 A | | 11/1993 | Okamura et al. | |
| 5,299,689 A | * | 4/1994 | Ledewitz | 206/503 |
| 5,420,222 A | * | 5/1995 | Stepp et al. | 528/31 |
| 5,535,925 A | | 7/1996 | Hinden et al. | |
| 5,588,560 A | | 12/1996 | Benedict | |
| 5,638,990 A | | 6/1997 | Kastberg | |
| 6,345,734 B2 | | 2/2002 | Schalow et al. | |
| 6,375,377 B1 | | 4/2002 | Lowery | |
| 6,659,278 B1 | | 12/2003 | Velliquette | |
| 6,880,735 B2 | | 4/2005 | Whitney | |
| 7,156,268 B2 | * | 1/2007 | Whitney | 222/539 |
| 7,255,249 B2 | * | 8/2007 | Whitney | 222/539 |

FOREIGN PATENT DOCUMENTS

| | | |
|---|---|---|
| JP | 08026316 | 1/1996 |
| JP | 2000219255 | 8/2000 |

OTHER PUBLICATIONS

European Search Report in 04250315.1-2309.
Product Description and drawing of product in use or on sale in Aug. 1997 (two pages).

* cited by examiner

*Primary Examiner*—Frederick C. Nicolas
(74) *Attorney, Agent, or Firm*—Philip D. Freedman PC; Philip D. Freeman; Kenneth S. Wheelock

(57) ABSTRACT

A viscous fluid dispenser includes a compressible body having a substantially tubular profile and including an interior fluid holding cavity and a head including a cap structure operatively connected to an operative end of the compressible body and a nozzle communicatively connected through the cap structure to form a continuous off-center passage through the head from the interior fluid holding cavity to an exterior fluid expressing side. A fluid dispenser package includes a compressible body having a substantially tubular profile with a cleft within the profile extending longitudinally to the body profile from a top end of the profile to a location intermediate along the profile to form a tapering cleft within the body profile; and a head including a cap structure and a nozzle communicatively connected through the cap to form a continuous passage through the head from an interior fitting side to an exterior fluid expressing side, wherein the head is removably stored at the body top end in a connection reversed to an operating connecting with the nozzle cradled in the cleft within the tubular profile of the flexible body. A method of applying a viscous fluid to a target area includes positioning a compressible viscous fluid dispenser comprising an angled dispensing nozzle at an angle from a perpendicular of the dispenser to the target area and compressing the dispenser to express viscous fluid directly onto the target.

20 Claims, 8 Drawing Sheets

VISCOUS POLYORGANOSILOXANE FLUID DISPENSER

This application is a division of Whitney Ser. No. 11,465,823, filed Aug. 21, 2006, now U.S. Pat. No. 7,255,249 which is a division application of Ser. No. 11,042,105, filed Jan. 26, 2005, now Whitney U.S. Pat. No. 7,156,268, which is a division application of Ser. No. 10,207,786, filed Jul. 31, 2002, now Whitney U.S. Pat. No. 6,880,735.

BACKGROUND OF THE INVENTION

The invention relates to a dispenser for dispensing a viscous fluid, to a package and to a method to dispense a viscous fluid. More particularly, the invention relates to dispensing a room-temperature vulcanizable (RTV) silicone rubber composition and more particularly a one component room temperature vulcanizable silicone rubber composition.

A one component RTV composition can comprise a silanol end-stopped diorganopolysiloxane polymer having a viscosity varying anywhere from 500 to 500,000 centipoise at 25° C. where an organic group of the polymer is a monovalent hydracarbon radical such as methyl or phenyl. A one-part RTV polyorganosiloxane composition that cures at room temperature to form an elastomer is widely used as an elastic gasket or sealant, adhesive or coating agent in electrical, electronic and construction industries. The RTV composition can comprise the silanol terminated polydiorganosiloxane and a cross-linking agent having more than two hydrolyzable groups per molecule. In a typical system, the crosslinking agent is methyltriacetoxy silane. When exposed to atmospheric moisture, the composition will begin to cure to form a skin in 10 to 20 minutes. The composition fully cures to a silicone elastomer in about 24 hours.

A one-part RTV composition can be formulated to have high temperature stability and weatherability characteristics. The composition can also be formulated to have enhanced resistance to oil swell. This composition is especially suitable as a gasketing composition or as a composition for formed-in placed gaskets, for example in automobiles.

In one application, an RTV composition can be used to seal sections of blocks or panels in construction, particularly in the construction of large buildings, such as high-rises. In construction, prefabricated sections or panels are brought together to a prescribed proximity that allows for expansion, contraction or for an expansion joint. Concrete blocks or panels are fabricated next to each other with a typical crevice distance of anywhere from ¼" to 1½" or more in width. Accordingly, it is necessary to seal the block or panel joints with an elastomer to complete construction and to allow for expansion and contraction.

A block or panel sealing operation is carried out by inserting a filler material into the crevice and applying a sealant over the filler material. The sealant cures in place to form the seal. Several devices are known for applying sealant. For example, Santefort, U.S. Pat. No. 5,217,144 shows a collapsible tube to dispense highly viscous materials such as silicone gasket RTV composition. The tube is used as part of a dispenser that includes two engaging plates for squeezing the sides of the tube to cause the tube contents to be expressed from an open end. The dispenser also includes two handles to be gripped by a workman in applying the RTV composition. Kruazona, U.S. Pat. No. 4,295,439 and Kruazona, U.S. Pat. No. 4,295,439 show devices that include a roller structure for use with a tube to apply RTV composition.

Oftentimes, the crevice is situated at a difficult to access location or angle. For example, the crevice forming blocks or panels may be situated high on a building facade where it is dangerous to take a known caulk gun or dispensing device that has flaring parts or obstructing parts. Other construction features may limit or obstruct access to the crevice or the crevice forming panels themselves may be located with respect to one another in a manner that permits only a sharp angle access to the crevice. Oftentimes, a workman must hold on to a support while situating himself so that he can put down an accurate bead of sealant. However, known dispensers for viscous materials such as RTV gasket sealant are difficult to use and do not permit dispensing uniform narrow beads that are required to provide quick forming, complete seals of structures that are placed in awkward, hard to reach obstructed locations.

There is a need for an economical and inexpensive device for accurately applying a silicone RTV composition to seal a crevice. Also, there is a need for a collapsible tube dispenser that can be operated with only one hand for use in cramped or awkward locations so that a bead produced by expressed contents of the tube can be placed upon a target.

BRIEF DESCRIPTION OF THE INVENTION

The invention provides an economical and inexpensive device for applying a viscous fluid to difficult to reach or obstructed locations. The invention provides a viscous fluid dispenser, comprising a compressible body having a substantially tubular profile and comprising an interior fluid holding cavity and a head comprising a cap structure operatively connected to an operative end of the compressible body and a nozzle communicatively connected through the cap structure to form a continuous off-center passage through the head from the interior fluid holding cavity to an exterior fluid expressing side.

In another embodiment, the invention relates to an integrally stored head viscous fluid dispenser package comprising a compressible body having a substantially tubular profile with a cleft within the profile extending longitudinally to the body profile from a top end of the profile to a location intermediate along the profile to form a tapering cleft within the body profile; and a head comprising a cap structure and a nozzle communicatively connected through the cap to form a continuous passage through the head from an interior fitting side to an exterior fluid expressing side, wherein the head is removably stored at the body top end in a connection reversed to an operating connection with the nozzle cradled in the cleft within the tubular profile of the flexible body.

In a final embodiment, the invention is a method of applying a viscous fluid to a target area, comprising positioning a compressible viscous fluid dispenser comprising an angled dispensing nozzle at an angle from a perpendicular of the dispenser to the target area and compressing the dispenser to express viscous fluid directly onto the target.

DETAILED DESCRIPTION OF THE INVENTION

Figure 1:
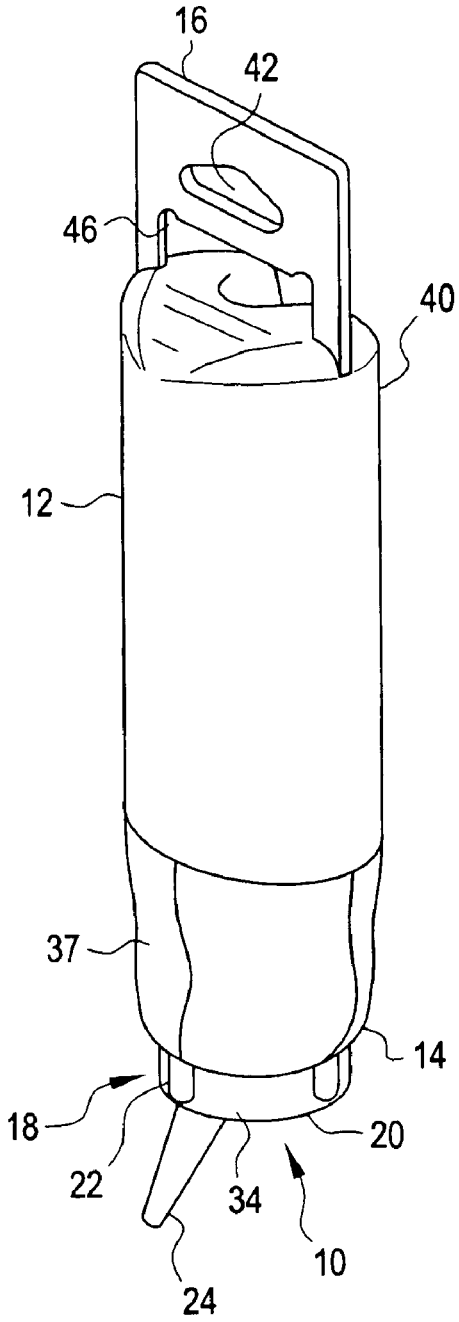
FIG. 1 and FIG. 2 are perspective views at different angles of a viscous fluid dispenser.
Figure 2:
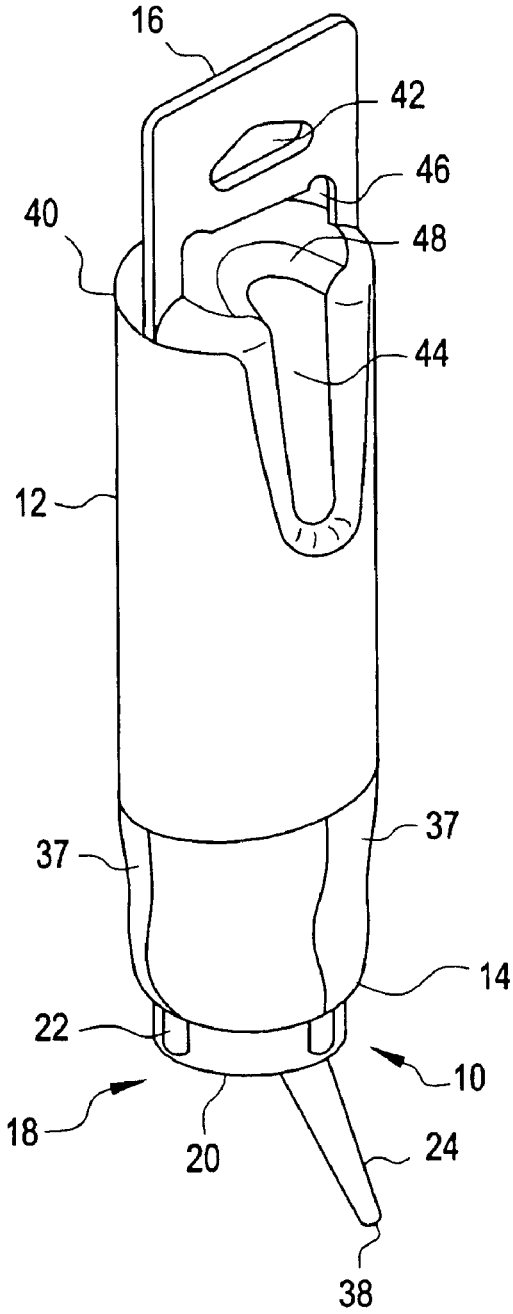
Figure 3:
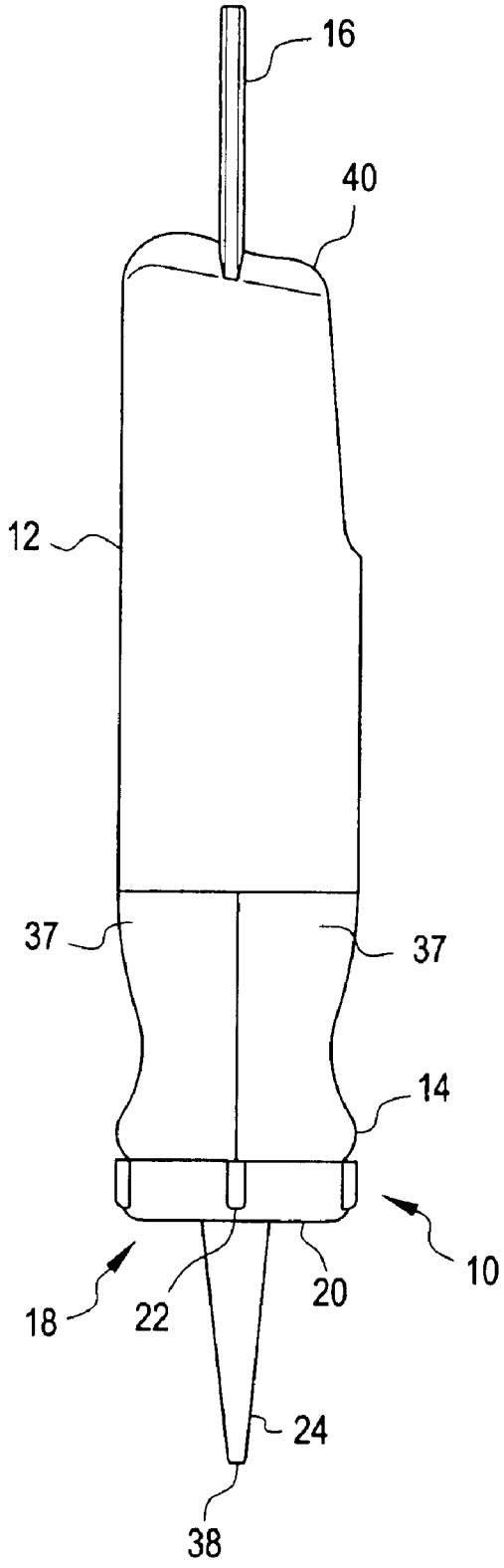
FIG. 3 is side elevation of the dispenser.
Figure 4:
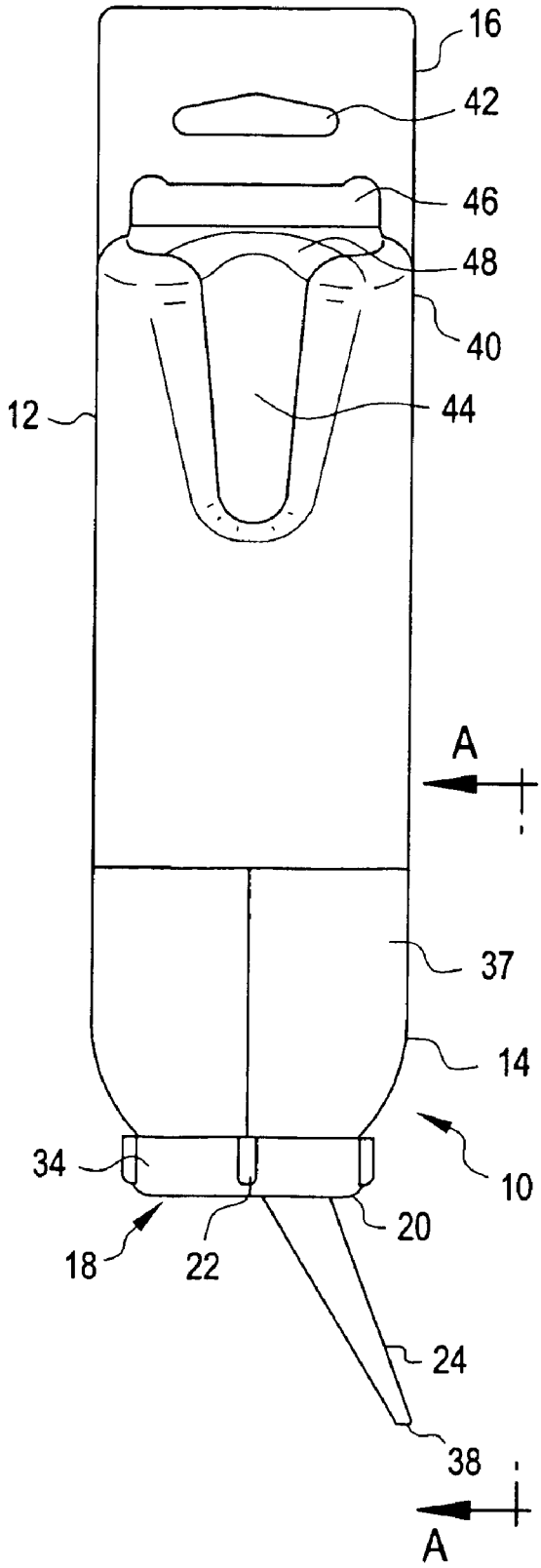
FIG. 4 is a front elevation of the dispenser.
Figure 5:
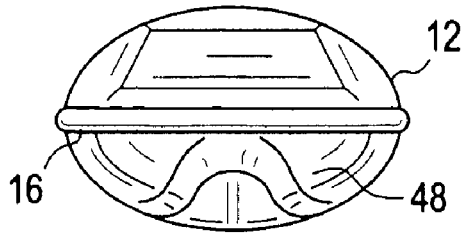
FIG. 5 is a plan view of the dispenser.
Figure 6:
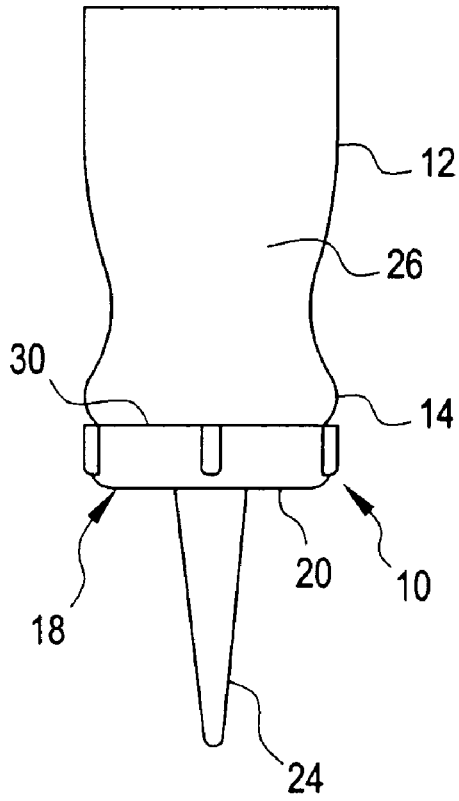
FIG. 6 is a cut away view through line A-A of FIG. 4.

The invention provides an inexpensive dispenser for dispensing a viscous fluid such as an uncured silicone gasketing composition to an assembly part or sealant to a crevice. According to the invention, an inexpensive device is provided to apply silicone sealant to seal crevices between plates or concrete blocks. The dispenser can be used to deliver a one-part RTV composition. The dispenser is simple in construction and also easy to use by hand. The dispenser has a nozzle of decreasing diameter that is attachable to an outlet channel of a cap for the collapsible tube, so that a straight bead of highly viscous material having narrow width can be accurately applied for sealing.

In an embodiment, the invention relates to a dispenser for room temperature vulcanizable silicone sealant polyorganosiloxane compositions, more particularly the room temperature curable polyorganosiloxane compositions that are rendered stable under moisture free hermetically sealed closed conditions and which cure upon contact with water present in ambient air at room temperature to form an elastomeric composition. Such compositions can include other ingredients. One of these basic ingredients can be from 4 to 400 parts of filler per 100 parts of the base polymer. The filler is desirably selected from reinforcing fillers such as fumed silica or precipitated silica which may be treated with such ingredients as cyclo polysiloxanes, alone or in combination with silazenes.

The dispenser of the invention works well to seal crevices in a hard to reach or inaccessible location. While the dispenser works well alone in this application, it can be used with an inserted backer rod between cinder block walls, brick walls and all types of masonry walls in which there is present a sizable crevice. It should also be noted that while preferred uses include applying a sealant of polyacrylate or a room temperature vulcanizable silicone rubber composition, the dispenser can be utilized for sealing with other types of sealants such as polysulfide sealants or for applying other compositions such as a calcium carbonate patch and repair composition.

Features of the invention will become apparent from the drawings and following detailed discussion, which by way of example without limitation describe preferred embodiments of the present invention.

FIGS. 1 to 6 are various views of a preferred embodiment of the viscous fluid dispenser of the invention. In these figures, the dispenser 10 includes a compressible molded tubular body 12 with an operative end 14, smoothing blade 16 and head 18. The compressible tubular body 12 has a substantially tubular profile and an interior fluid holding cavity 26 shown in FIG. 6 to contain the viscous fluid. The body 12 can be constructed of a flexible, polymeric structural material such as polypropylene or polyethylene. At operative end 14, the body 12 includes an expressing port 28 for loading fluid into cavity 26 and discharging fluid from within the cavity 26.

Figure 7:
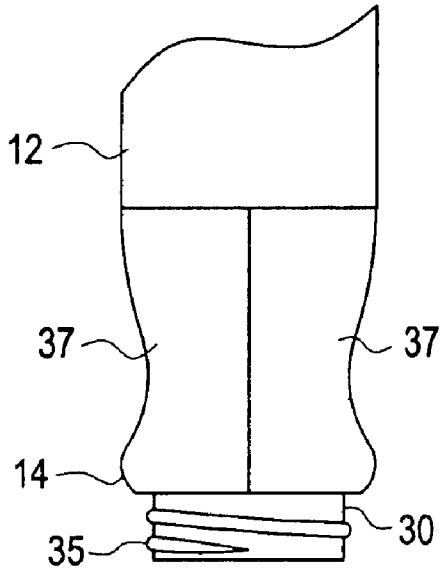
FIG. 7 is a side elevation of the dispenser with head removed.

Head 18 comprises a cap structure 20 shown connected to an operative end 14 of the compressible body 12 and nozzle 24. The cap structure 20 is substantially "cap-shaped," comprising a disk cover 32 with extending lip 34 that mates with projecting edge 30. As shown with reference to FIGS. 6 and 7, head 18 can be removed from tubular body 12 to permit loading viscous fluid such as a silicone sealant into cavity 26 and the head 18 can be re-secured to the body 12 by means of threads 35 at operative end 14 to form a fit. The structure 20 includes ribs 22 along the outer circumference of the extending lip 34 to provide a manual turning grip to facilitate removing and securing the head 18 at operative end 14.

Figure 8:
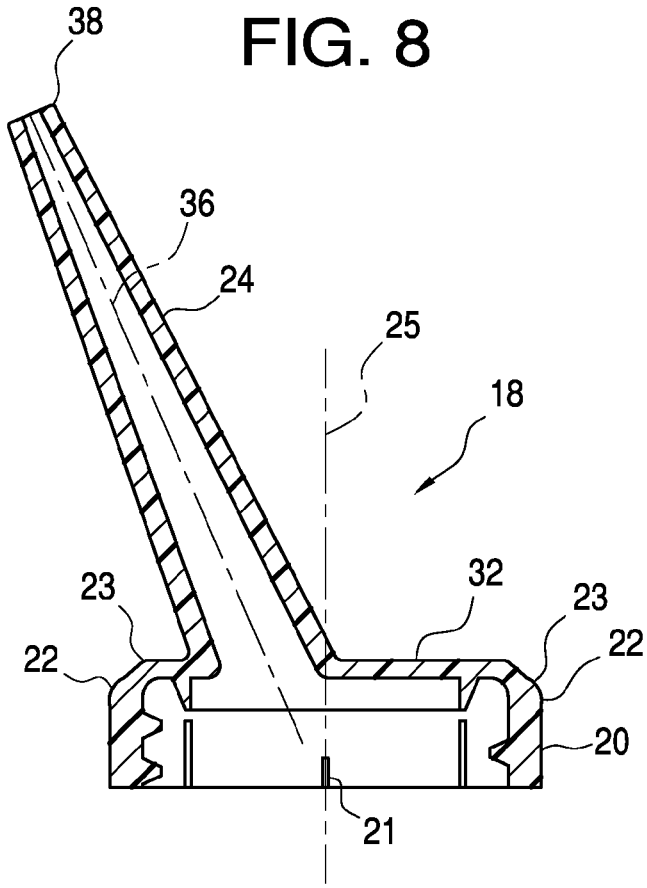
FIG. 8 is a cut away side view of the dispenser head.
Figure 9:
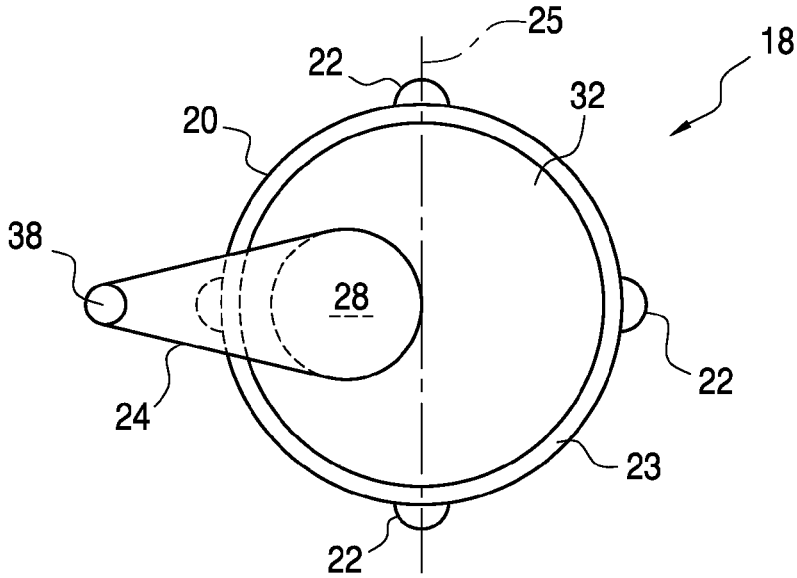
FIG. 9 is a perspective view of the head from the top.

Further with reference to FIGS. 8 and 9, nozzle 24 is "off-center" connected through the disk cover 32 to form a passage 36 from the cover 32, through the tapering interior of the nozzle 24 to terminate at nozzle tip 38. The passage 36 interconnects the cavity 26 of body 12 so that fluid can be expressed from within the cavity 26 to the exterior. As shown, nozzle 24 transects through cap structure 20 at an off-center position. By "off-center" is meant that the nozzle 24 transects the cap structure 20 at a position other than the cap structure center 21. The advantage of this feature can be described with reference to FIG. 10, which illustrates application of sealant to a position that may be obstructed by a bulkhead (shown in phantom as 52) or to access corners.

The "off set" positioning of the nozzle 24 can be described and defined with regard to a virtual plane 25 that transects the center of structure 20, normal to the cap disk cover 32. The nozzle 24 orifice center 36 at intersection with disk cover 32, is positioned off the virtual plane between 2% to 99% of a distance between the cap center 21 and its edge 23. Desirably, the nozzle 24 is positioned between 15% to 50% from the center 21 to the edge 23 and preferably 25% to 35% from the center 21 to the edge 23. Additionally, the nozzle can be angled from 1 to 45 degrees from the transecting plane normal to the cap 20. Desirably, the nozzle is angled from 10 to 35 degrees from the normal plane and preferably, 15 to 30 degrees from the plane.

Figure 10:
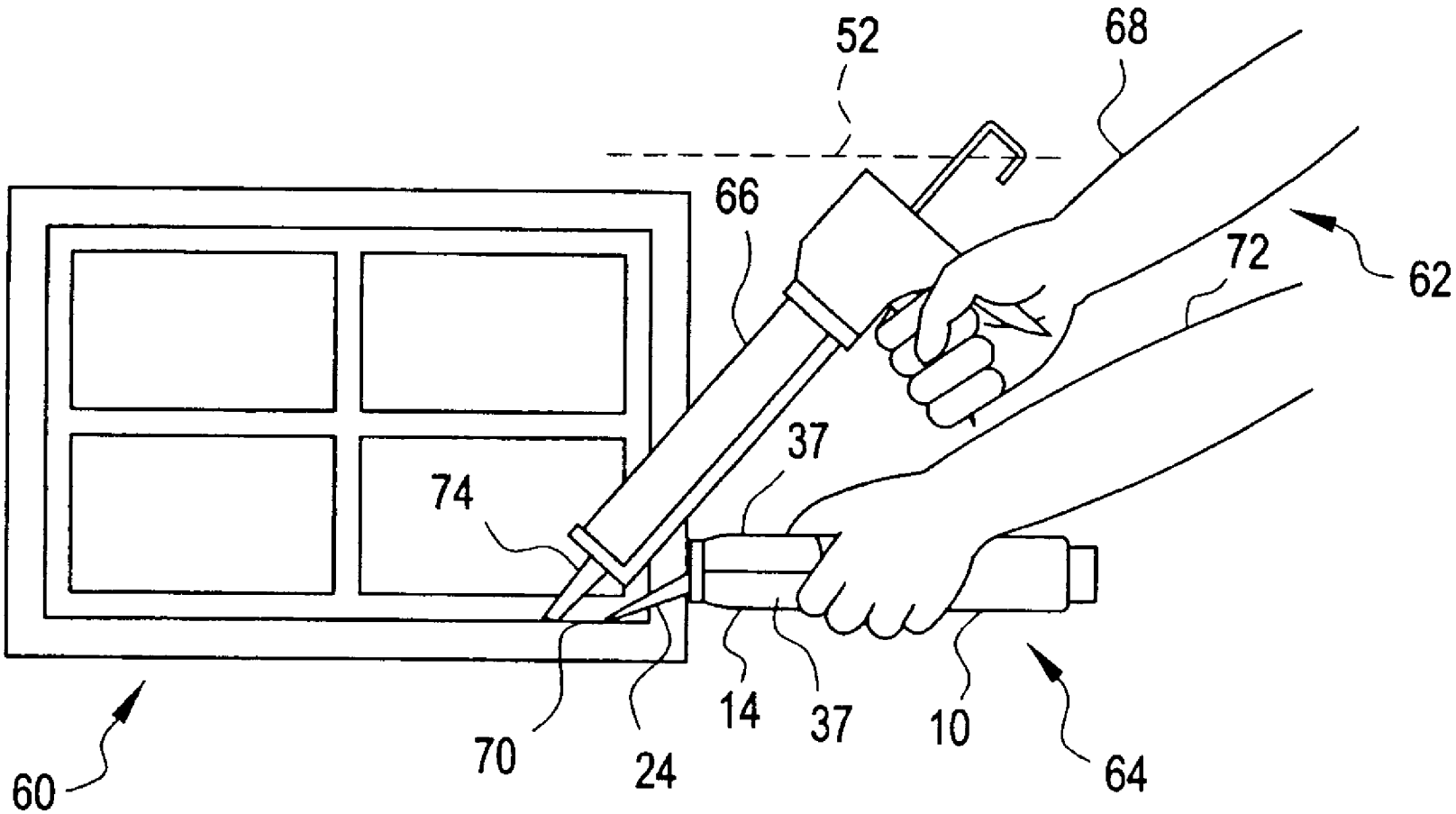
FIG. 10 depicts application of RTV with the dispenser to an otherwise obstructed location or awkward to reach position.
Figure 11:
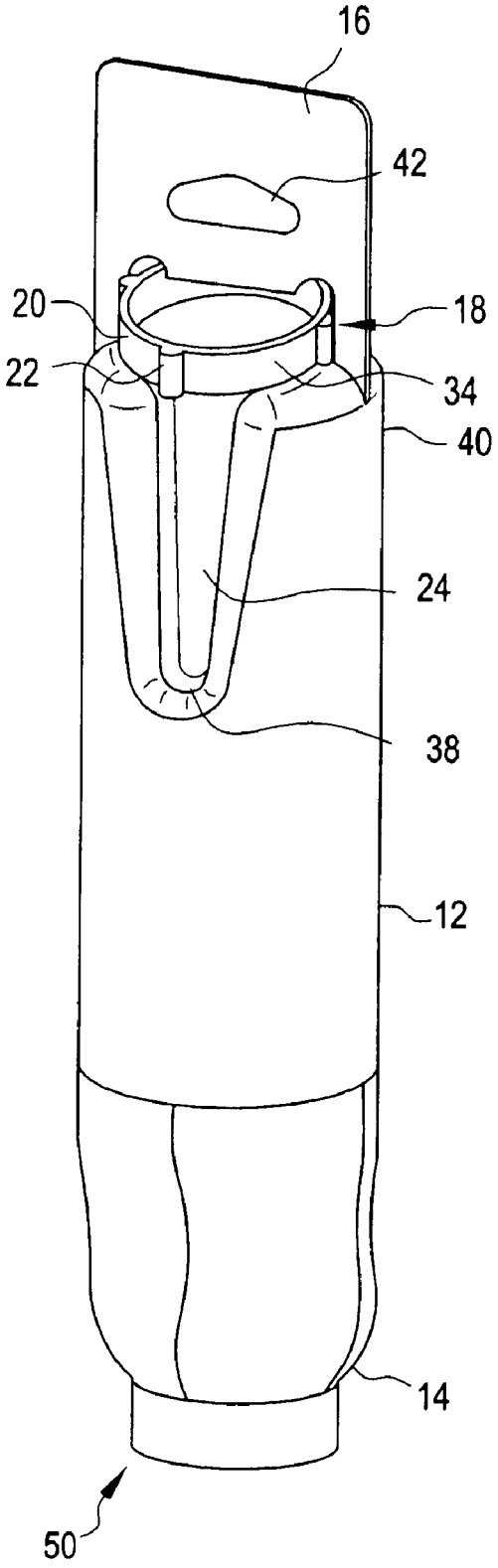
FIG. 11 is a perspective view of an integral stored nozzle viscous fluid dispenser package.
Figure 12:
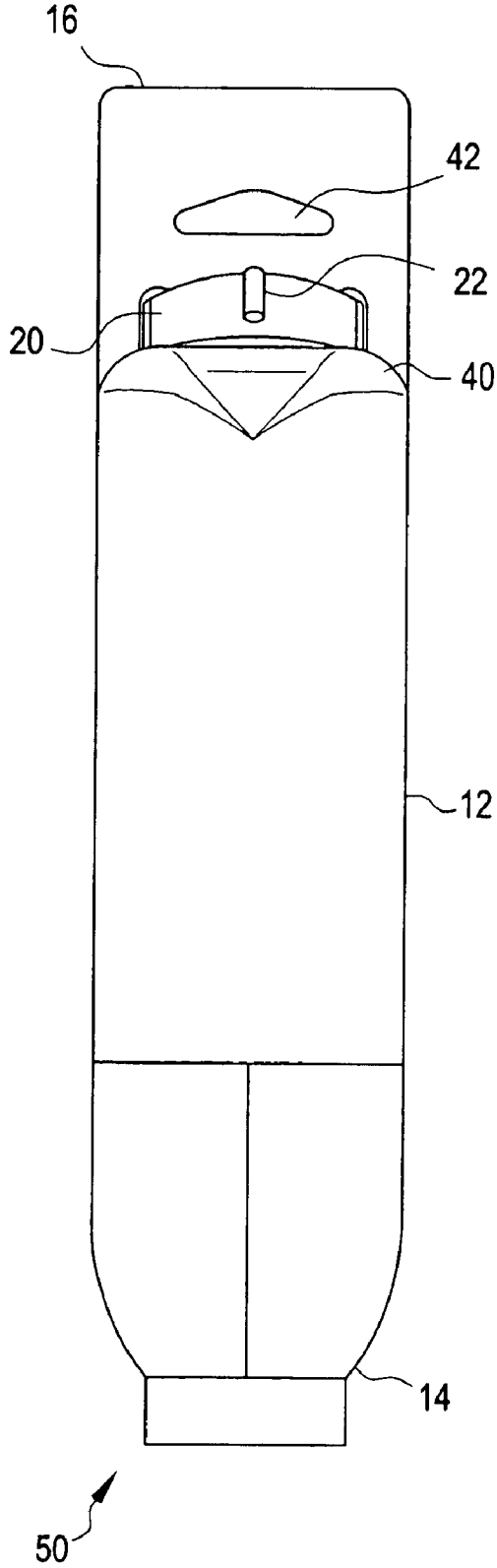
FIG. 12, FIG. 13 and FIG. 14 are elevation views of the package.
Figure 13:
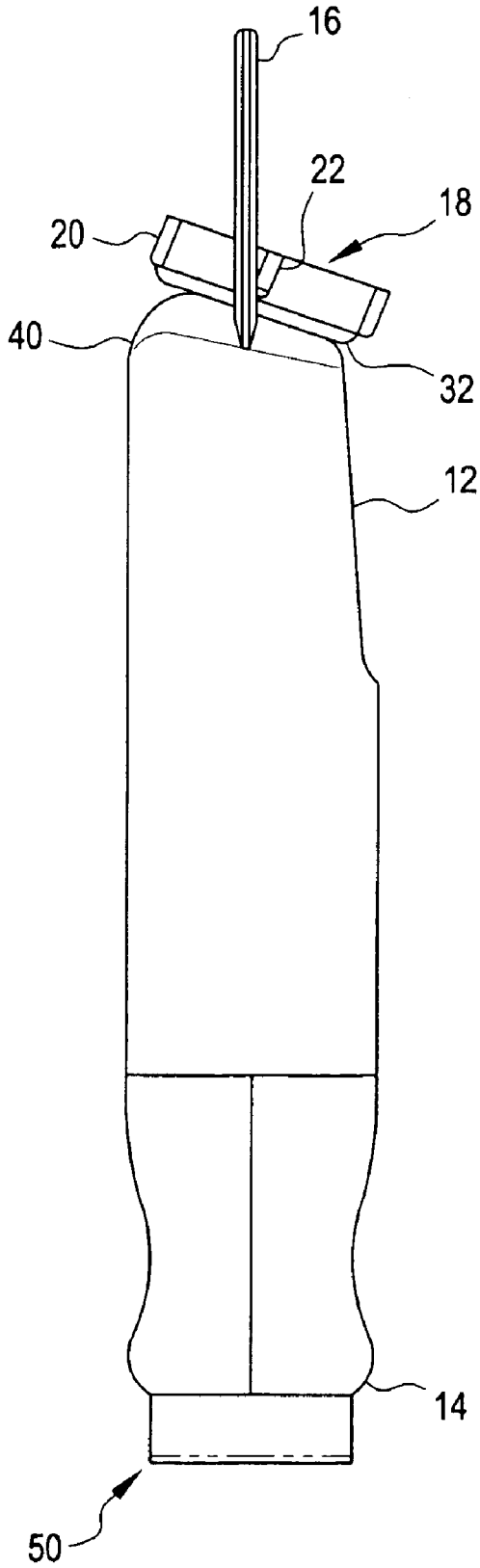
Figure 14:
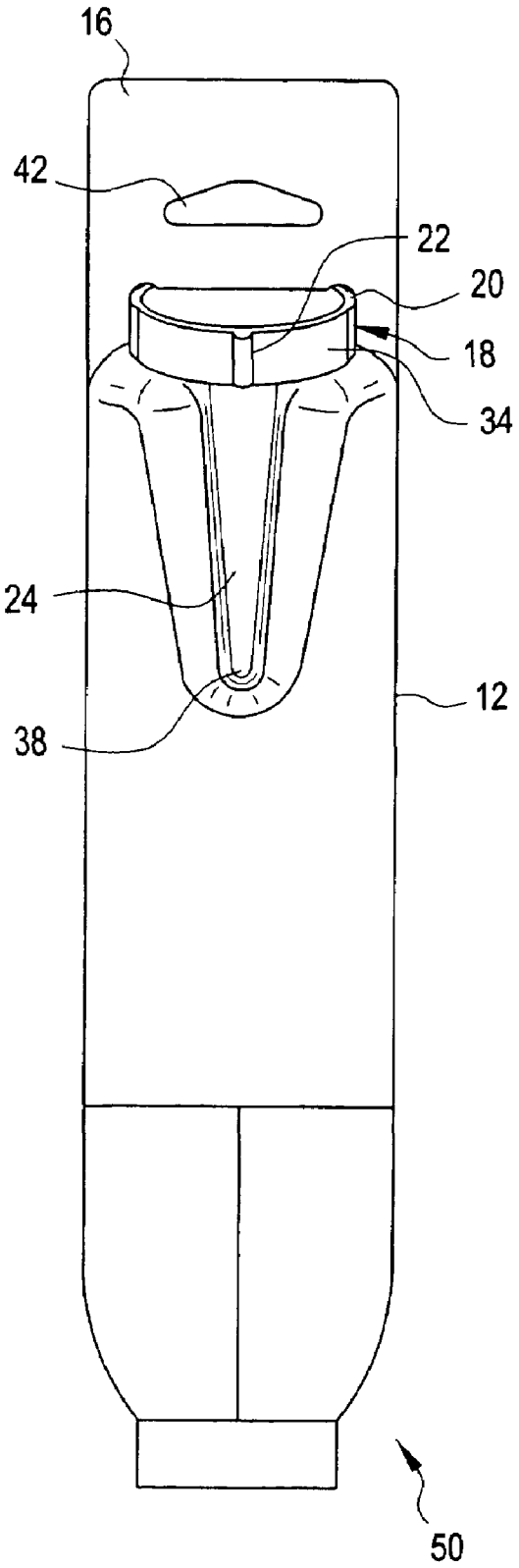
Figure 15:
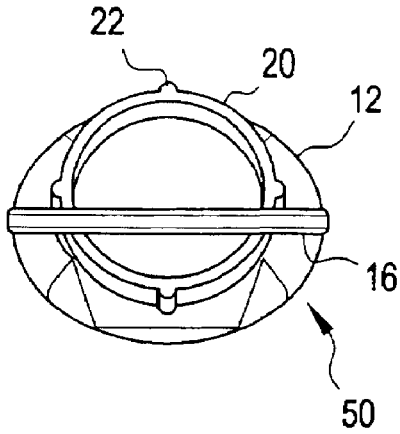
FIG. 15 is a plan view of the package.

Advantages of the invention are illustrated in FIG. 10. This figure shows application of RTV to a window seal area 60 with a conventional dispenser illustrated generally at 62 compared to application with a dispenser of the invention illustrated generally at 64. The elongated, straight centered conventional dispenser nozzle 72 requires a workman's arm 68 to be raised at an awkward angle with respect to sealant area 70. In contrast, RTV is easily applied to the area 70 with a straight extension of a workmen's arm 72 with the present dispenser 10. An obstructing upper bulkhead illustrated in phantom at 52 will prevent application by the conventional dispenser as illustrated at 62. On the other hand, on account of the off-set, angled juxtaposition of the nozzle 24 of the dispenser 10, the bulkhead 52 presents no difficulty to sealant application at 64.

Another advantage of the invention is illustrated in FIG. 10. In FIG. 10, the workman grasps the dispenser 10 toward its operative end 14. As illustrated in FIGS. 1 through 7, this end is formed in a taper by slightly converging panels 37. This construction provides a nipping area that can be squeezed with one hand to expel viscose fluid. Average grip strength of an adult male is about 60 to 120 pounds and 40 to 80 pounds for a female. In one embodiment of the invention, fluid can be expelled from the dispenser 10 with one hand by the application of less than 40 pounds of force. The dispenser can be operated by application of as little as 12 pounds force. This permits application by a workman who may be in an awkward position that requires him to steady himself with one hand, allowing operation of the dispenser with only his free hand.

FIGS. 11 to 15 illustrate a package embodiment of the invention. The tubular body 12 includes a smoothing blade 16 attached to a top end 40 opposite its operative end 14. Smoothing blade 16 is a flat shaped blade that extends from the top end 40 for use in smoothing fluid that is expressed at the operative end 14. The blade includes a notch 42 that can be used to hang the dispenser 10 as a package for storage on a hook when not in use.

With further reference to FIG. 2 and FIGS. 11 to 15, the tubular body 12 is impressed with an indent within its body profile that extends longitudinally to the body 12 from a top end 40 to a location intermediate along the body 12 to form an interrupting tapering cleft 44. The smoothing blade 16 also includes a slot 46. The cleft 44 of body 12 and slot 46 of blade 16 are cooperatively shaped and positioned with respect to one another to respectively accommodate the nozzle 24 and the cap structure 20 to accommodate head 18 for storing when the head 18 is not connected for use at the body operative end 14. The FIGs. show a dispenser package 50 that includes head 18 fitted within an area defined by the cooperatively shaped and positioned cleft 44 and slot 46. As shown in FIGS. 1 to 6, the cleft 44 includes tapered side walls 48 to facilitate impression of nozzle 24 as the head 18 is snap fitted into the cleft 44 and slot 46 for storage.

In operation, a workman removes integral stored head 18 from the cleft 44 of the viscous fluid dispenser 10. An end cap 45 on the bottom of the viscous fluid dispenser body 12 is removed, and the off-set, angled nozzle head 18 is threaded on to the body 12 for application, as for example as shown and described with reference to FIG. 10.

While preferred embodiments of the invention have been described, the present invention is capable of variation and modification and therefore should not be limited to the precise details of the Examples. The invention includes changes and alterations that fall within the purview of the following claims.

What is claimed is:

1. A viscous polyorganosiloxane fluid dispenser, comprising:

a compressible body having a substantially tubular profile and comprising an interior fluid holding cavity; a head comprising a cap structure operatively connected to an operative end of the compressible body and a nozzle communicatively connected through the cap structure to form a continuous off-center passage through the head from the interior fluid holding cavity to an exterior fluid expressing side; and a molded extension from a top end of the tubular body opposing the operative end and comprising a flat area, straight edge smoothing blade to smooth applied viscous polyorganosiloxane fluid and a notch to suspend the polyorganosiloxane fluid dispenser for storing, wherein the blade has a slot to accommodate, the cap structure of the head for storing the head when not connected for use at the operative end of the tubular body.

2. The dispenser of claim 1, wherein the nozzle is slanted from its connection to form an angled projection from the head.

3. The dispenser of claim 1, wherein the nozzle tapers from its connection to form a tip for expressing a bead of viscous fluid from the interior fluid holding cavity.

4. The dispenser of claim 1, comprising a cleft within the profile extending longitudinally to the profile from a top end of the profile to a location intermediate along the profile to form an interrupting tapering cleft within the body profile.

5. The dispenser of claim 1, wherein the compressible body comprises a substantially tubular profile with a tapering profile portion for clasping and activating fluid expression.

6. The dispenser of claim 1, wherein the nozzle is off-set connected through the cap head.

7. The dispenser of claim 1, wherein nozzle is angled 1 to 45 degrees from a perpendicular to the cap head.

8. The dispenser of claim 1, wherein nozzle is angled 10 to 35 degrees from a perpendicular to the cap head.

9. The dispenser of claim 1, wherein nozzle is angled 15 to 30 degrees from a perpendicular to the cap head.

10. The dispenser of claim 1, comprising a body that can be compressed to express the polyorganosiloxane fluid from its interior by the application of a force of 12 to less than 40 pounds.

11. The dispenser of claim 1, wherein the blade comprises a V-shaped notch.

12. A viscous polyorganosiloxane fluid dispenser, comprising:

a compressible body having a substantially tubular profile and comprising an interior fluid holding cavity; a head comprising a cap structure operatively connected to an operative end of the compressible body and a nozzle communicatively connected through the cap structure to form a continuous off-center passage through the head from the interior fluid holding cavity to an exterior fluid expressing side;

a molded extension from a top end of the tubular body opposing the operative end and comprising a flat area, straight edge smoothing blade to smooth applied viscous polyorganosiloxane fluid and a notch to suspend the polyorganosiloxane fluid dispenser for storing; and further comprising a cleft within the profile extending longitudinally to the profile from a top end of the profile to a location intermediate along the profile to form an interrupting tapering cleft within the body profile.

13. The dispenser of claim 12, wherein the nozzle is slanted from its connection to form an angled projection from the head.

14. The dispenser of claim 12, wherein the nozzle tapers from its connection to form a tip for expressing a bead of viscous fluid from the interior fluid holding cavity.

15. The dispenser of claim 12, wherein the compressible body comprises a substantially tubular profile with a tapering profile portion for clasping and activating fluid expression.

16. The dispenser of claim 12, wherein the nozzle is off-set connected through the cap head.

17. The dispenser of claim 12, wherein nozzle is angled 1 to 45 degrees from a perpendicular to the cap head.

18. The dispenser of claim 12, wherein nozzle is angled 10 to 35 degrees from a perpendicular to the cap head.

19. The dispenser of claim 12, wherein nozzle is angled 15 to 30 degrees from a perpendicular to the cap head.

20. The dispenser of claim 12, comprising a body that can be compressed to express the polyorganosiloxane fluid from its interior by the application of a force of 12 to less than 40 pounds.

* * * * *